US005722575A

United States Patent [19]

Smith

[11] Patent Number: 5,722,575

[45] Date of Patent: Mar. 3, 1998

[54] GRIP-ASSISTING ACCESSORY

[75] Inventor: Paul Arthur Smith, Glenview, Ill.

[73] Assignee: Eversharp Pen Company, Franklin Park, Ill.

[21] Appl. No.: 609,779

[22] Filed: Mar. 1, 1996

[51] Int. Cl.[6] ..... A41D 19/00; B65D 19/00

[52] U.S. Cl. ..... 224/217; 224/901.4; 15/443; 401/8

[58] Field of Search ..... 224/217, 218, 224/219, 220, 221, 222, 267, 901.4; 401/6, 7, 8; 74/551.9; 434/260; 602/22, 901; 623/65; 15/443

[56] References Cited

U.S. PATENT DOCUMENTS

| | | | |
|---|---|---|---|
| D. 27,737 | 10/1897 | Meloche . | |
| D. 206,896 | 2/1967 | Flely . | |
| D. 286,650 | 11/1986 | Fischer . | |
| D. 328,920 | 8/1992 | Kimball . | |
| D. 333,676 | 3/1993 | Bedol . | |
| D. 342,968 | 1/1994 | Meinke . | |
| D. 342,969 | 1/1994 | Edwards . | |
| 426,324 | 4/1890 | Ramsey . | |
| 967,410 | 8/1910 | Montgomery . | |
| 1,206,976 | 12/1916 | Barth | 401/8 |
| 2,273,044 | 2/1942 | Johnson . | |
| 2,292,324 | 8/1942 | Lawrence . | |
| 4,148,424 | 4/1979 | Fortenberry . | |
| 4,602,885 | 7/1986 | Bischoff et al. . | |
| 4,733,808 | 3/1988 | Turner, Jr. et al. | 224/219 |
| 4,738,556 | 4/1988 | Brown . | |
| 5,267,945 | 12/1993 | Doctor et al. | 602/14 |

OTHER PUBLICATIONS

Velcro Product News, Velco International Ltd., p. 11, Feb. 1975.

*Primary Examiner*—Henry J. Recla
*Assistant Examiner*—Timothy L. Maust
*Attorney, Agent, or Firm*—Hill, Steadman & Simpson

[57] ABSTRACT

A grip-assisting accessory is provided which aids a person in holding and manipulating a hand-held utensil, such as a writing instrument, paintbrush, eating utensil, or toothbrush. The accessory includes a sleeve which fits snugly over the item to be gripped, such as a pen barrel or paintbrush handle. A strap is attached to and extends from the sleeve. The strap is wrappable around at least one finger held alongside the sleeve. The strap is securable to the sleeve to hold the item securely and comfortably to user's finger.

15 Claims, 2 Drawing Sheets

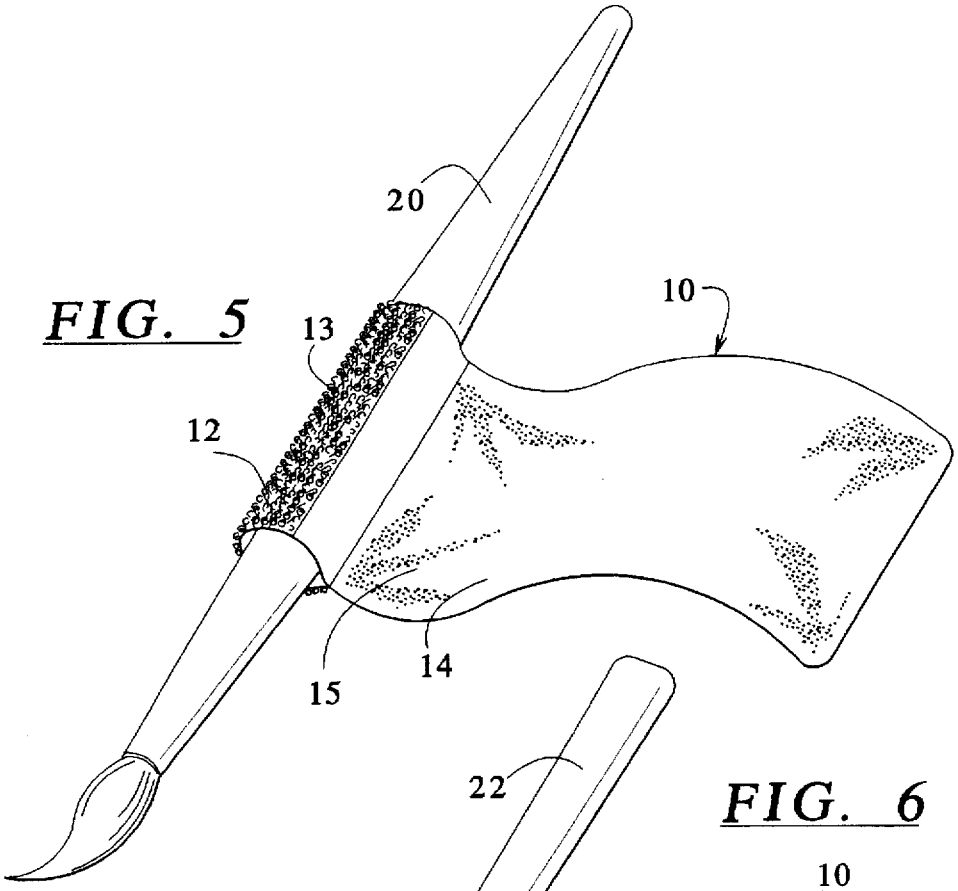
FIG. 5
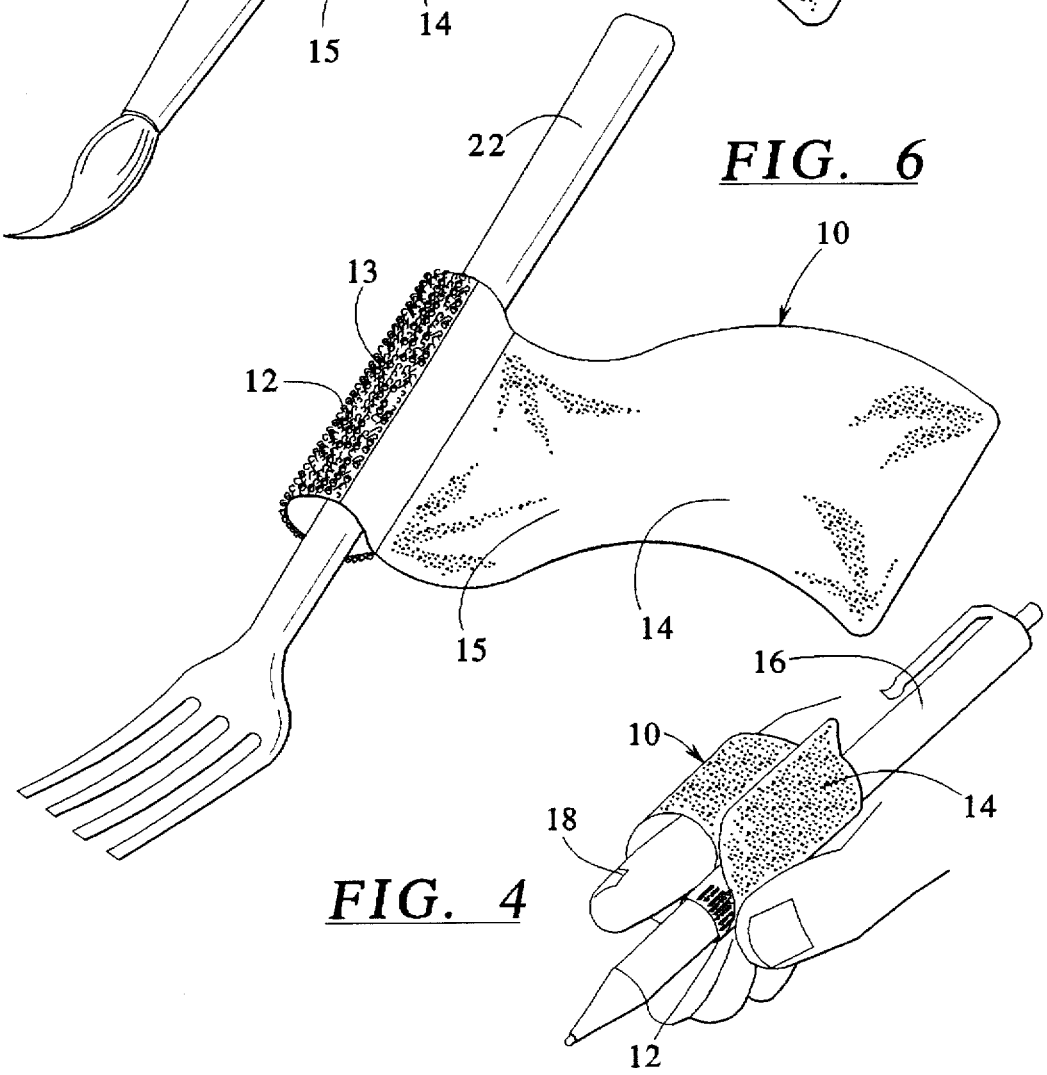
FIG. 6
FIG. 4

GRIP-ASSISTING ACCESSORY

BACKGROUND OF THE INVENTION

The present invention generally relates to a device which helps a person grip an item. More specifically, the present invention relates to a strap-like device which secures an item (e.g., a writing instrument, paintbrush, eating utensil, toothbrush or the like) to a person's finger.

Certain disabilities can frustrate a person's performing of day-to-day activities. For example, people who suffer from arthritis often find it difficult to properly manipulate standard utensils, such as writing devices. Grip-assisting devices can aid in a person's ability to perform such a task.

Various structures are known for assisting persons in gripping writing instruments. For example, U.S. Pat. No. 4,638,556 relates to a short, stub-like pen securable to a person's fingertip. A padded tongue extends from the pen tip for supporting the pen on a finger. A hook-and-loop strap secured to the tongue wraps around a finger to secure the pen. The user then manipulates his fingertip to write with the pen. That device is not adaptable for use with a conventional writing instrument.

Other structures are known for securing a conventional writing instrument to a finger. Examples of such devices are disclosed in U.S. Pat. No. 967,410, 2,292,324, 2,273,044 and U.S. Des. Patents No. 27,737, 328,920, 342,968, and 342,969. Each of those devices includes a non-adjustable sleeve or ring for fitting over a finger and an attached loop or clip for holding a pen or pencil adjacent the finger.

While known devices might provide some assistance in writing, an improved grip-assisting accessory is needed which provides improved performance, comfort, adjustability, and versatility.

SUMMARY OF THE INVENTION

The present invention provides a new and improved grip-assisting accessory which may be used in a variety of applications. To this end, the accessory includes a sleeve sized to fit snugly over a hand-held type item, such as the barrel of a pen or pencil. A flexible strap is attached, preferably longitudinally, to the sleeve. As a person's finger lies along the sleeve, the strap can be wrapped over the finger and secured. This holds the writing instrument at an ideal writing position in one's hand. Facilitating this, in a preferred embodiment, the sleeve and strap are provided with areas of respectively cooperating hook and loop materials.

This arrangement secures the instrument securely in a gripping position within a user's hand. The hook-and-loop material embodiment provides great comfort and is adaptable to fit virtually any user's finger size. It has also been found that the present invention provides greater performance for tasks, such as writing, than previous devices, particularly those having a ring-like element to fit over the finger. The accessory of the present invention aids gripping by anyone, particularly disabled people, such as arthritis sufferers. Moreover, the accessory may be used as a developmental tool for training children to properly hold a writing instrument.

The hook-and-loop material may be arranged in any suitable location so that the hook material securably engages the loop material when the strap is in the wrapped-over position. In a preferred embodiment, the hook material longitudinally covers the sleeve for at least part of its circumference. The area of hook material may, in an embodiment, extend from the sleeve along the strap. The area of loop material is disposed along the strap on a side which engages the hook material when wrapped over.

In addition to an embodiment adapted for writing utensils, embodiments are possible wherein the sleeve snugly receives a paintbrush handle, a fork or spoon, a toothbrush, a razor or hairbrush, or many other items having a handle. The sleeve may be specially designed for receiving a particular sized handle, or the sleeve may be adjustable to fit various items. Also, in an embodiment, the sleeve may be provided of a size to accommodate various items which have a common dimension, such as a popular pen barrel size. The present invention is advantageous in this versatility of use environments.

Therefore, advantages of the present invention include providing an improved grip-assisting accessory for a writing instrument or other item, which is comfortable, adjustable to any user, versatile and exhibits improved performance. The accessory of the present invention is more comfortable because the strap is flexible and adjustable. The invention further provides the advantage of being usable by either fight-handed or left-handed people.

Additional features and advantages of the present invention are described in, and will be apparent from, the detailed description of the preferred embodiments, the drawings, and the claims.

BRIEF DESCRIPTION OF THE DRAWINGS

FIG. 4 is a perspective view of the grip-assisting accessory of FIG. 1 as used to hold a writing instrument against a user's finger, the strap being wrapped the top of the finger around to the bottom.

FIG. 5 is a perspective view of a grip-assisting accessory according to an embodiment of the present invention wherein a paintbrush is snugly held within the sleeve.

FIG. 6 is a perspective view of a grip-assisting accessory according to an embodiment of the present invention wherein an eating utensil is snugly held within the sleeve 12.

DETAILED DESCRIPTION OF THE PREFERRED EMBODIMENTS

Figure 1:
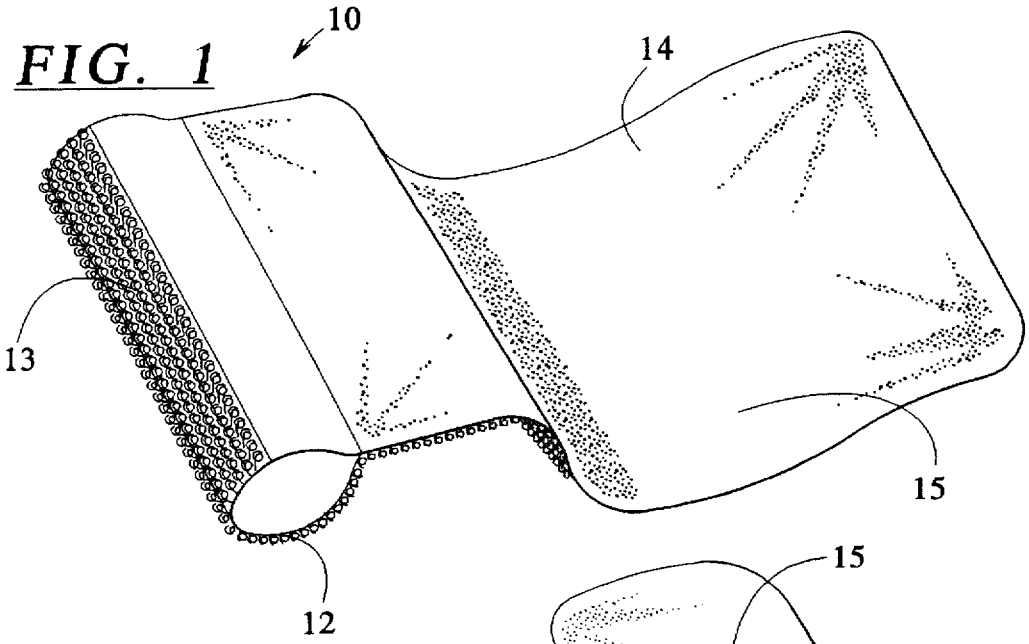
FIG. 1 is a perspective view of a grip-assisting accessory according to an embodiment of the present invention.

Now turning to the Figures, a grip-assisting accessory 10 according to an embodiment of the present invention is illustrated in FIG. 1. As shown, the accessory 10 includes a sleeve 12 which is generally cylindrical, having an interior sized to snugly fit over an elongated instrument, as described in greater detail below. The accessory 10 also includes a strap 14, which is attached to and extends from the sleeve 12.

The sleeve 12 and strap 14 are preferably each made of a fabric or other flexible sheet-like material. A width of the strap 14 is preferably about equal to a length of the sleeve 12. The accessory 10 may be made of a single piece of fabric which is looped over and bonded at a seam, or the sleeve 12 and strap 14 may include separate elements attached together. In an alternative embodiment, the sleeve 12 may be made of a rigid material, while the strap 14 is flexible.

Figure 2:
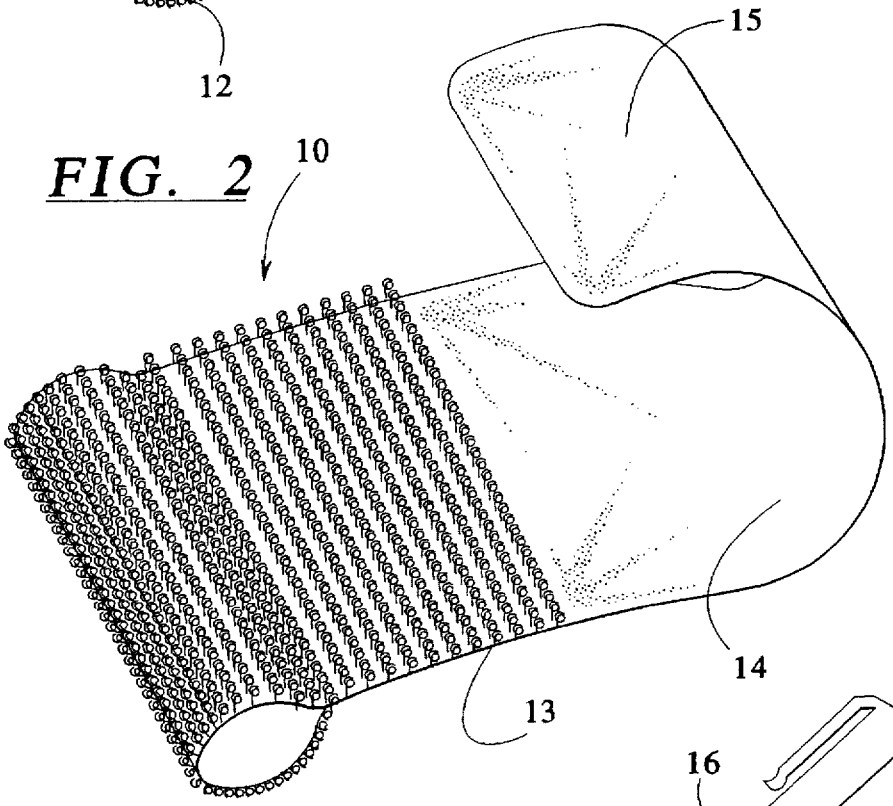
FIG. 2 is a perspective view of the grip-assisting accessory according to FIG. 1 as seen from an opposite side.

The accessory 10 includes cooperating areas of hook material 13 and loop material 15. These areas 13, 15 are arranged so that they engage each other when the strap 14 is wrapped over a finger. The hook material 13 and loop material 15 may be respectively located in any suitable locations to provide the securable engagement. As shown in FIGS. 1 and 2, however, the hook material 13 longitudinally covers the sleeve at least partly around its outer circumference. Also, in the preferred embodiment shown, the hook material 13 extends at least partly along a side of the strap 14. Loop material 15 is disposed on an opposite side of the strap 14. In a preferred embodiment, the loop material 15 partially covers the sleeve 12, as shown, to provide comfort for the wrapped finger. The hook and loop materials 13, 15 may be facing on the fabrics used to construct the accessory 10, or may be patches secured over a fabric base.

Figure 3:
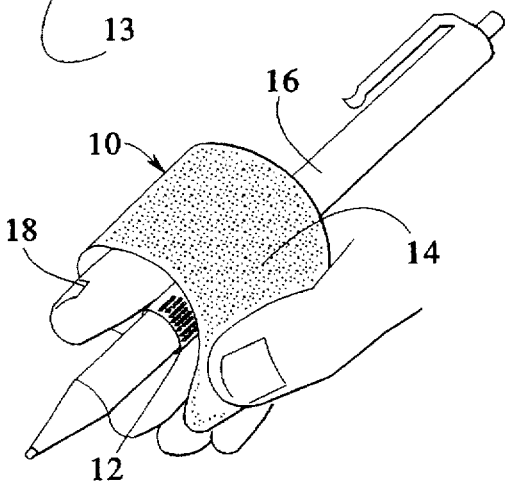
FIG. 3 is a perspective view of the grip-assisting accessory of FIG. 1 as used to hold a writing instrument against a user's finger, the strap being wrapped from under the finger over the top.

The sleeve 12 is adapted to slidably fit over and receive an item to be gripped. As shown in FIGS. 3 and 4, the sleeve is fit over the barrel of a writing instrument 16, such as a pen (shown) or pencil. To use the accessory 10, a user positions at least one finger 18 generally longitudinally along the sleeve 12. The strap 14 is then wrapped over the finger 18 and back around in a generally overlapping manner.

The strap 14 is secured in the wrapped position around the finger 18 by the cooperating respective areas of hook-and-loop material 13 and 15. The strap 14 is wrapped so that the side with the loop material 15 contacts against the finger 18. The loop material 15 contacts the hook material 13 in the wrapped position.

As illustrated in FIG. 3, the strap 14 is wrapped from the sleeve 12 from the bottom of the finger 18 over the top. As illustrated in FIG. 4, the strap 14 is wrapped from the sleeve 12 over the top of the finger around the bottom. The accessory 10 may be used in either wrapping style, depending on which a user prefers. Also, the writing instrument 16 or other item may be inserted in the sleeve 12 in an opposite direction, depending on whether a person wishes to use the accessory in his right hand or left hand.

As mentioned, the accessory 10 may be used for grip-assistance of many suitable items. FIG. 5 illustrates an example of the accessory 10 wherein the sleeve 12 is fit over a handle of a paintbrush 20 to be gripped. Also, FIG. 6 illustrates an example of the accessory 10 wherein the sleeve 12 receives a handle of an eating utensil 22.

The accessory 10 has the sleeve 12 sized to fit numerous items with different functions. For example, the same sleeve 12 may receive properly sized handles of a selected writing instrument 16, paintbrush 20, or eating utensil 22. In fact, specialized products may be provided having barrel and handle shapes specifically for use with the accessory 10. It has been found that items with a rubberized surface, such as a pen 16 with a rubberized barrel, work particularly well with the grip-assisting accessory 10. It has also been found that enlarged-diameter handles are grippable particularly well by disabled persons using the accessory 10. Such an enlarged-diameter handle gives a greater surface area for the sleeve 12 and a person's hand to grip.

Other embodiments of the present invention could include a stretchable sleeve 12 for adapting to various sized handles. Also, embodiments are possible wherein the sleeve 12 is adjustable in its loop diameter size, such as with a buckle.

Various changes and modifications to the presently preferred embodiments will be apparent to those skilled in the art. Such changes and modifications may be made without departing from the spirit and scope of the present invention and without diminishing its attendant advantages. Therefore, the appended claims are intended to cover such changes and modifications.

What is claimed is:

1. A grip-assisting device for use with elongated item to be held in a user's hand, the device comprising:

an elongated sleeve adapted to snugly receive the elongated item, the sleeve having an outer surface defining a length of the sleeve, the outer surface providing substantial longitudinal contact with at least one finger of the user's hand;

a flexible strap having a proximate end and a distal end defining a length therebetween, the flexible strap attached to the sleeve along a width of the flexible strap at the proximate end generally longitudinally to the sleeve and extending substantially perpendicularly from a central axis of the sleeve wherein the length of the strap is sufficient to wrap over both the at least one finger of the user's hand and at least a portion of the elongated sleeve to substantially immobilize the at least one finger with respect to the sleeve and further wherein the width of the flexible strap at the proximate end is equal to the length of the sleeve; and means for maintaining the strap in a wrapped position over both the at least one finger of the user's hand and the portion of the sleeve.

2. The grip-assisting device of claim 1, further comprising:

means for securing the distal end of the strap to the elongated sleeve after the strap is wrapped over both the at least one finger of the user's hand and the portion of the sleeve.

3. The grip-assisting device of claim 1, further comprising:

hook material on the distal end of the strap and loop material on the sleeve wherein the hook material is attached to the loop material after the strap is wrapped over both the at least one finger of the user's hand and the portion of the sleeve.

4. The grip-assisting device of claim 1, further comprising:

loop material on the distal end of the strap and hook material on the sleeve wherein the loop material is attached to the hook material after the strap is wrapped over both the at least one finger of the user's hand and the portion of the sleeve.

5. The grip-assisting device of claim 1, further comprising:

hook material on one face of the strap and loop material on an opposite face of the strap wherein the hook material is attached to the loop material after the strap is wrapped over both the at least one finger of the user's hand and the portion of the sleeve.

6. A method of assisting a user with gripping an elongated item with the user's hand, the method comprising the steps of:

inserting the elongated item into an elongated sleeve;

placing at least one finger of the user in substantially parallel and contiguous contact with an outer longitudinal surface of the sleeve, the outer longitudinal surface defining a length of the sleeve;

providing a flexible strap having a proximate end and a distal end forming a length therebetween;

wrapping both the at least one finger of the user and at least a portion of the elongated sleeve with the flexible strap to substantially immobilize the at least one finger with respect to the sleeve, the proximate end attached to the sleeve along its width generally longitudinally to the sleeve at a distal end and extends substantially perpendicularly therefrom wherein the width of the flexible strap at the proximate end is equal to the length of the sleeve; and maintaining the strap in a wrapped position after the strap is wrapped over both the at least one finger of the user's hand and the portion of the sleeve.

7. The method according to claim 6, further comprising the step of:

securing the distal end of the strap to the elongated sleeve after the strap is wrapped over both the at least one finger of the user's hand and the portion of the sleeve.

8. The method according to claim 6, further comprising the step of:

connecting hook material which covers at least part of the distal end of the strap to loop material which covers at least part of the sleeve after the strap is wrapped over both the at least one finger of the user's hand and the portion of the sleeve.

9. The method according to claim 6, further comprising the step of:

connecting loop material which covers at least part of the distal end of the strap to hook material which covers at least part of the sleeve after the strap is wrapped over both the at least one finger of the user's hand and the portion of the sleeve.

10. The method according to claim 6, further comprising the step of:

connecting hook material on one face of the strap to loop material on an opposite face of the strap after the strap is wrapped over both the at least one finger of the user's hand and the portion of the sleeve.

11. A method of assisting a user with gripping, the method comprising the steps of:

providing a writing instrument having ink therein;

inserting the writing instrument into an elongated sleeve;

placing at least one finger of the user in substantially parallel and continuous contact with an outer longitudinal surface of the sleeve;

wrapping both the at least one finger of the user and at least a portion of the elongated sleeve with a flexible strap to substantially immobilize the at least one finger with respect to the sleeve, the strap having a proximate end attached generally longitudinally to the sleeve at a distal end and extending substantially perpendicularly therefrom; and maintaining the strap in a wrapped position after the strap is wrapped over both the at least one finger of the user's hand and the portion of the sleeve.

12. The method according to claim 11 further comprising the step of:

securing the distal end of the strap to the elongated sleeve after the strap is wrapped over both the at least one finger of the user's hand and the portion of the sleeve.

13. The method according to claim 11 further comprising the step of:

connecting hook material which covers the distal end of the strap to loop material which covers the sleeve after the strap is wrapped over both the at least one finger of the user's hand and the portion of the sleeve.

14. The method according to claim 11 further comprising the step of:

connecting loop material which covers the distal end of the strap to the hook material which covers the sleeve after the strap is wrapped over both the at least one finger of the user's hand and the portion of the sleeve.

15. The method according to claim 11 further comprising the step of:

connecting hook material on one face of the strap to loop material on an opposite face of the strap after the strap is wrapped over both the at least one finger of the user's hand and the portion of the sleeve.

* * * * *